US008475147B2

(12) United States Patent
Losinske et al.

(10) Patent No.: US 8,475,147 B2
(45) Date of Patent: Jul. 2, 2013

(54) GAS/FLUID INHIBITOR TUBE SYSTEM

(75) Inventors: Michael J. Losinske, Hominy, OK (US); Jim Hardee, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 194 days.

(21) Appl. No.: 12/904,187

(22) Filed: Oct. 14, 2010

(65) Prior Publication Data

US 2011/0110803 A1 May 12, 2011

Related U.S. Application Data

(60) Provisional application No. 61/260,477, filed on Nov. 12, 2009.

(51) Int. Cl.
*F04B 47/06* (2006.01)
*E21B 43/38* (2006.01)

(52) U.S. Cl.
USPC ..... 417/423.9; 166/105.5

(58) Field of Classification Search
USPC ..... 166/105.5, 265, 105, 68; 417/423.9, 417/423.3, 424.2
See application file for complete search history.

(56) References Cited

U.S. PATENT DOCUMENTS

| | | | | |
|---|---|---|---|---|
| 5,154,588 | A * | 10/1992 | Freet et al. | 417/423.3 |
| 5,203,682 | A * | 4/1993 | Inklebarger | 417/435 |
| 6,457,531 | B1 * | 10/2002 | Bangash et al. | 166/369 |
| 6,761,215 | B2 | 7/2004 | Morrison et al. | |
| 7,069,985 | B2 * | 7/2006 | Wang | 166/68 |
| 2002/0178924 | A1 | 12/2002 | Brown et al. | |
| 2004/0238179 | A1 * | 12/2004 | Murray et al. | 166/369 |
| 2009/0065202 | A1 * | 3/2009 | Brown et al. | 166/267 |
| 2011/0024123 | A1 * | 2/2011 | Brown et al. | 166/369 |

OTHER PUBLICATIONS

Search Report and Written Opinion for PCT/US2010/055848 dated Jan. 10, 2011.

* cited by examiner

*Primary Examiner* — Devon Kramer
*Assistant Examiner* — Bryan Lettman
(74) *Attorney, Agent, or Firm* — Paul Herman; Baker Botts L.L.P.

(57) ABSTRACT

A pump assembly having an inhibitor tube is provided for lifting produced fluids to the surface. The pump assembly includes a pump and may optionally include a gas separator. The pump assembly includes an inhibitor tube having an outlet configured to be in fluid communication with the suction opening of either the pump or the gas separator. The inhibitor tube allows for the separation of gas from the produced fluid prior to the produced fluid entering the gas separator or the pump.

17 Claims, 4 Drawing Sheets

GAS/FLUID INHIBITOR TUBE SYSTEM

CROSS-REFERENCE TO RELATED APPLICATIONS

This application claims the benefit of U.S. Provisional Application No. 61/260,477, which was filed Nov. 12, 2009 and is hereby incorporated by reference in its entirety.

BACKGROUND

The present invention relates to an electric submersible pump assembly and, more particularly, to assemblies and methods for reducing gas content of produced fluids.

Commercially viable levels of production from hydrocarbon wells may require assistance in lifting produced fluids to the surface. Formation pressure may be inadequate to drive produced fluids upward to the surface. In deeper wells, hydrostatic head may act downwardly, inhibiting flow to the surface.

Frequently, an underground pump is used to force fluids toward the surface. An electric submersible pump (ESP) may be installed in a lower portion of the wellbore. In wells with high volumes of gas, gas separators may also be included, to separate gas from the rest of the produced fluids. The gas may be separated in a mechanical or static separator and vented to the annulus. The remainder of the produced fluid may enter the ESP, which may pump it to the surface via production tubing.

In wells producing gas, the ESP may be used to pump water out of the wellbore to maintain the flow of methane gas. In this instance, the water is pumped up production tubing, while the methane gas flows up the annulus between the production tubing and the wellbore. However, some methane gas entrained in the water will be pumped by the pump. Wells that are particularly "gassy" may experience a significant amount of the methane gas passing through the pump, which may cause gas lock, resulting in costly and time-consuming shutdowns.

SUMMARY

The present invention relates to an electric submersible pump assembly and, more particularly, to assemblies and methods for reducing gas content of produced fluids.

In some aspects, a pump assembly is disclosed. The pump has a suction opening. A motor is configured to drive the pump. The pump includes an inhibitor tube having an outlet configured to be in fluid communication with the suction opening.

In other aspects, a pump assembly is disclosed. The pump assembly includes a pump and a gas separator configured to receive fluid via a suction inlet and discharge a substantially liquid portion toward the pump. The pump assembly further includes an inhibitor tube having an inhibitor outlet disposed proximate to the suction inlet.

In yet other aspects, a method for pumping is disclosed. The method includes providing an assembly. The assembly includes a pump having a suction opening in fluid communication with produced fluids, a motor configured to drive the pump, and an inhibitor tube having an inhibitor outlet in fluid communication with the suction opening. The method further includes placing the assembly in a wellbore and powering the motor to actuate the pump. Produced fluids are allowed to pass through the inhibitor tube and separate into a substantially gas portion and a substantially liquid portion. The substantially liquid portion is pumped up through production tubing. The substantially gas portion is allowed to move upward through an annulus.

Various features and advantages of the present invention will be apparent to those skilled in the art from the description of the preferred embodiments which follows when taken in conjunction with the accompanying drawings. While those skilled in the art may make numerous changes, such changes are within the spirit of the invention.

BRIEF DESCRIPTION OF THE DRAWINGS

The following drawings illustrate certain aspects of some embodiments of the present invention, and should not be used to limit or define the invention.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present invention relates to an electric submersible pump assembly and, more particularly, to assemblies and methods for reducing gas content of produced fluids.

Figure 1:
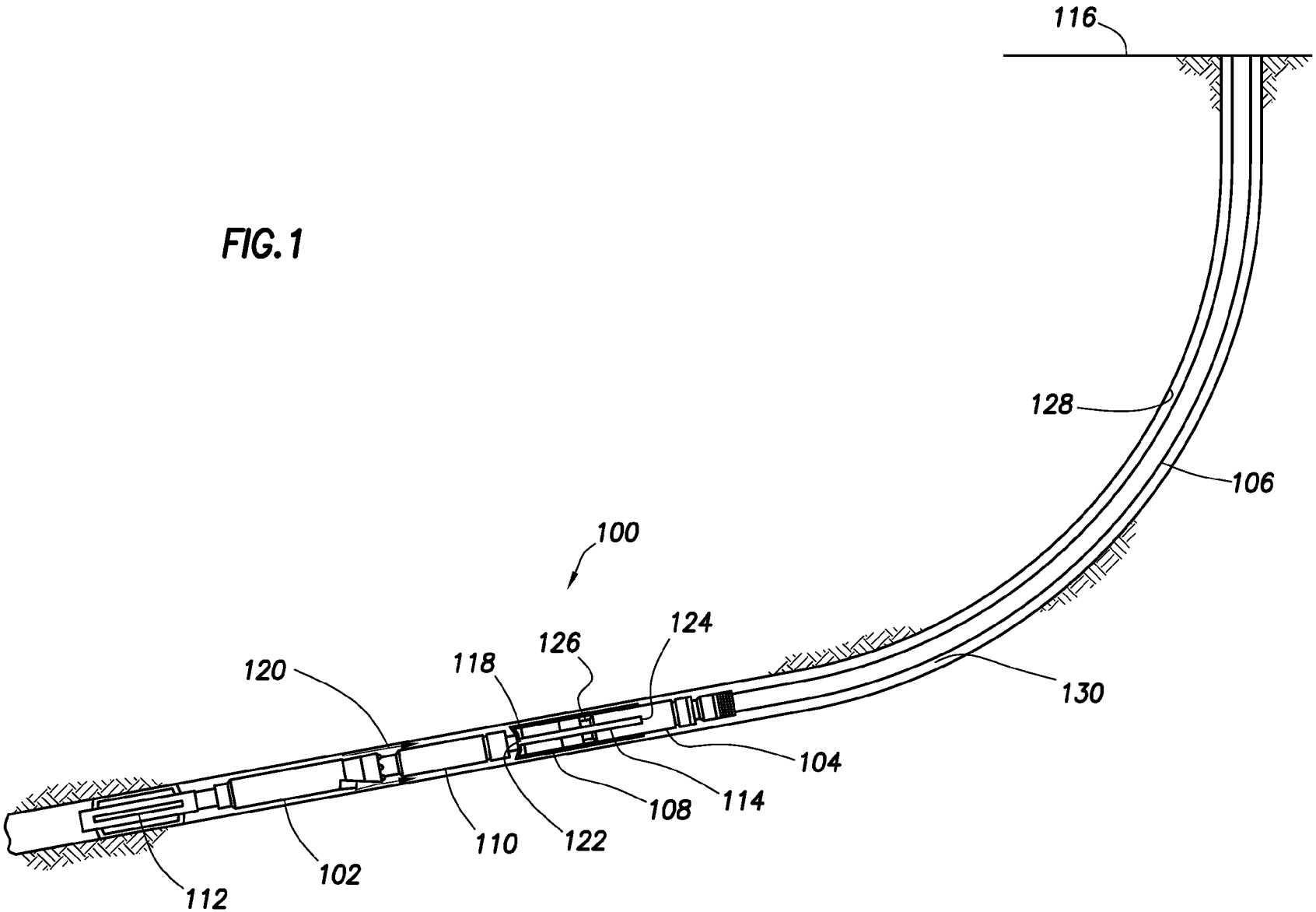
FIG. 1 is a side view of a pump assembly in a wellbore, in accordance with an exemplary embodiment of the present invention.

Referring to FIG. 1, pump assembly 100 may be positioned in wellbore 128. Pump assembly 100 may include pump 104 coupled to production string 106. Pump 104 may connect to production string 106 via threaded engagement or any other connection known to one having ordinary skill in the art. Production string 106 may be any type of conduit used to collect produced fluids 120 from subterranean formations, including, but not limited to coiled tubing, jointed pipe, and other tubulars.

Pump 104 may be coupled to gas separator 108 and motor 102. Protector 110 may be installed between pump 104 and motor 102. Centralizer 112 may be installed below motor 102. Inhibitor tubes 114 may be installed proximate to pump 104. A central shaft (not shown) may extend from motor 102 and through protector 110 for engaging a central shaft (not shown) of gas separator 108 and a central shaft (not shown) of pump 104. Produced fluids 120 may be separated by an internal rotating element with blades coupled to the shaft of gas separator 108.

Pump 104 may be configured to pressurize produced fluids 120 for production at surface 116. For example, pump 104 may be a charger pump, a tapered pump, an ESP, or any other type of pump configured to pump oil, water, gas, or other produced fluids 120 through production string 106 to surface 116. For example, pump 104 may be a submersible pump available from Goulds Pumps, Inc. of Seneca Falls, N.Y. Pump 104 may be integrally formed with gas separator 108, or pump 104 may attach to gas separator 108 via connections known to those having ordinary skill in the art.

Gas separator 108 may separate substantially gas portions out of produced fluids 120, allowing for more efficient pumping of produced fluids 120 to surface 116. Gas separator 108 may have an inducer pump or auger (not shown) at a downhole end to aid in lifting produced fluids 120 to the blades (not shown). Centrifugal force created by rotating elements of gas separator 108 may cause denser fluid (i.e., fluid having more liquid content) to move toward an outer wall of gas separator 108. Produced fluids 120 may travel upward through gas separator 108 toward a flow divider adapted to allow the denser fluid to flow toward pump 104, while diverting the less dense fluid toward discharge openings 126 to move into annulus 130. Gas separator 108 may be a vortex gas separator, for example, a vortex gas separator available from REDA Pump Company.

Figure 2:
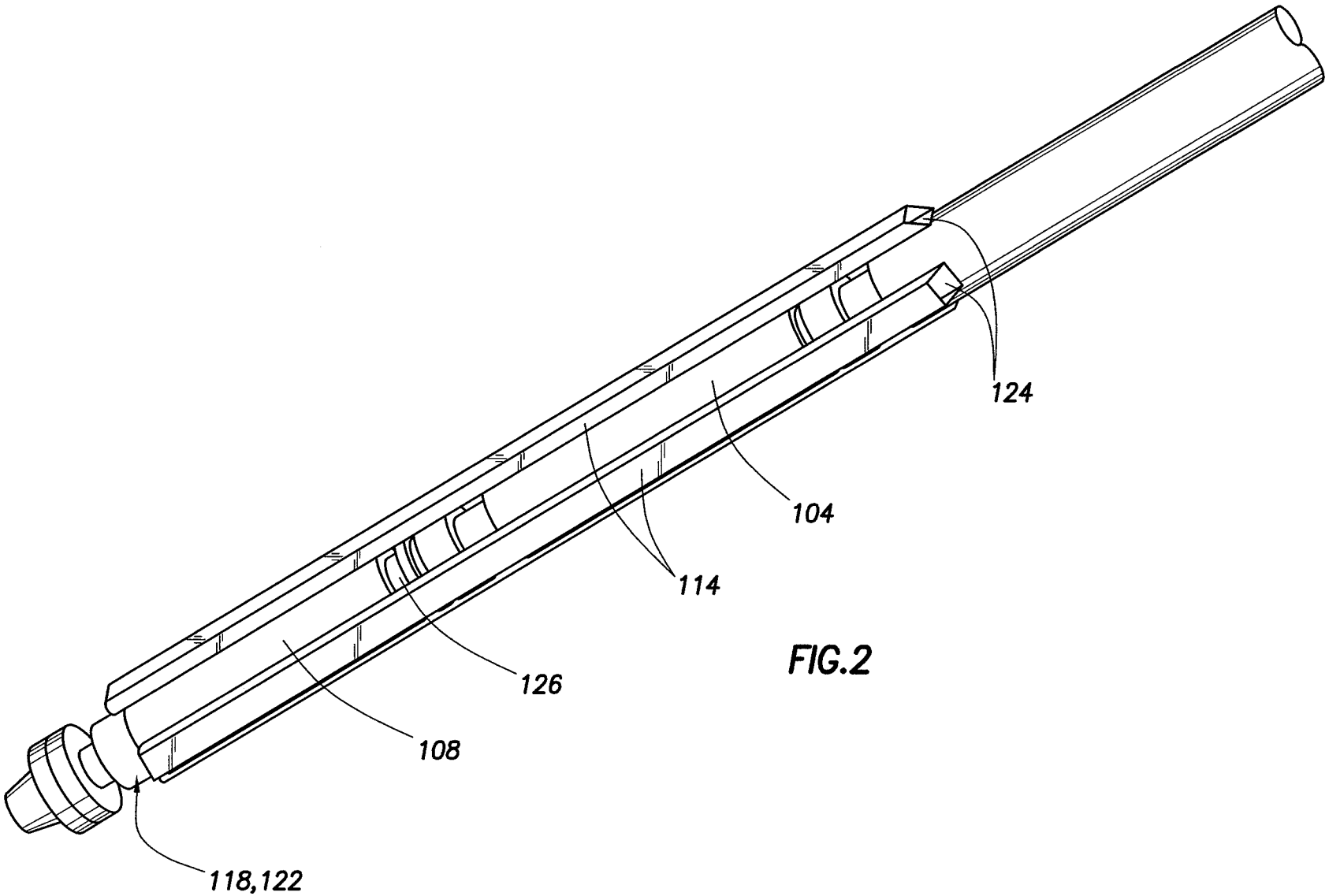
FIG. 2 is a top/side orthogonal view of a portion of the pump assembly of FIG. 1, in accordance with an exemplary embodiment of the present invention.
Figure 3:
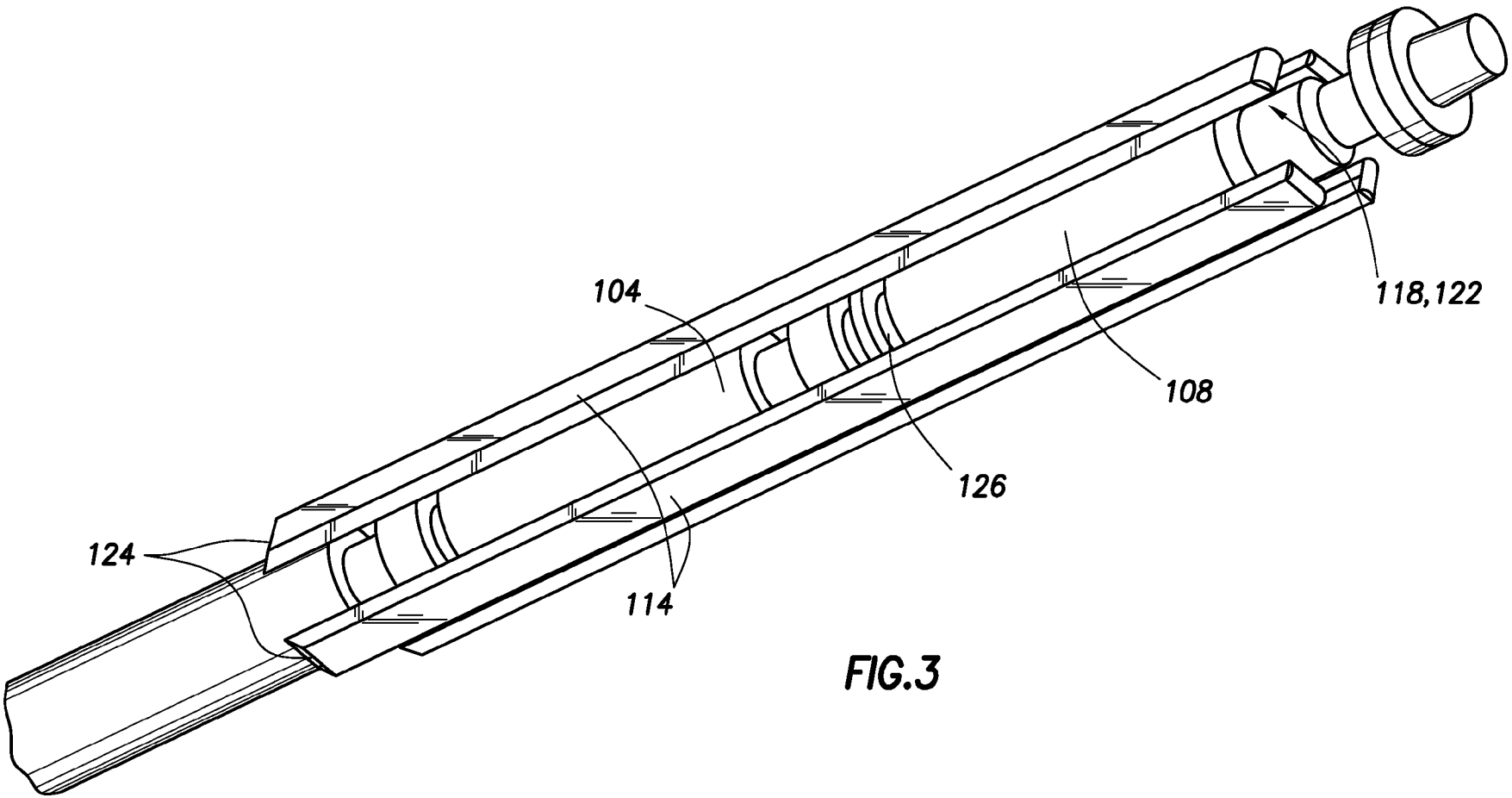
FIG. 3 is a bottom/side orthogonal view of a portion of the pump assembly of FIG. 1, in accordance with an exemplary embodiment of the present invention.

Referring to FIGS. 2 and 3, pump 104 and/or gas separator 108 may have suction openings 118 in fluid communication with produced fluids 120. Suction openings 118 may be distal from production string 106, such that produced fluids 120 may enter from annulus 130 through suction openings 118, and into gas separator 108. As produced fluids 120 pass through gas separator 108, substantially gas portions may pass through discharge openings 126 back into annulus 130, while remaining produced fluids 120 pass upward through production string 106 to surface 116. As illustrated, discharge openings 126 may be "above" or uphole of suction openings 118.

Inhibitor tubes 114 may have intake 124 "above" or uphole of discharge openings 126, and outlet 122 in fluid communication with suction openings 118, such that discharge openings 126 are between intake 124 and outlet 122. For example, outlet 122 may be welded, or otherwise situated or attached at or near suction openings 118. In some embodiments, outlet 122 may be sealed together with suction openings 118, such that any produced fluids 120 passing through outlet 122 necessarily pass through suction openings 118. In particular embodiments, all suction openings 118 may be associated with inhibitor tubes 114, such that all produced fluids 120 entering pump 104 have passed through inhibitor tubes 114. Thus, inhibitor tubes 114 may allow for produced fluids 120 to be drawn from above discharge openings 126 and introduced to suction openings 118.

Inhibitor tubes 114 may allow for produced fluids 120 to pass into suction openings 118 after being allowed to naturally separate. The extra time and/or movement of produced fluids 120 created by use of inhibitor tubes 114 before introduction into suction openings 118 may allow for gas trapped within produced fluids 120 to form bubbles. As these bubbles break free from the remainder of produced fluids 120, the gas therein may move upward through annulus 130 without passing through pump 104. This may prevent excessive gas portions of produced fluids 120 from entering pump 104, which may reduce gas lock associated with excess gas in pump 104.

The length of inhibitor tubes 114 may vary, depending on the size of pump 104, the rate of production, and other factors unique to a given location. In some embodiments, inhibitor tubes 114 may be constructed of 18-gauge steel with dimensions of approximately 0.75 inches by 1.5 inches by 10 feet. While four rectangular inhibitor tubes 114 are illustrated, any number or shape of inhibitor tubes would be suitable, depending on the particular conditions (e.g., clearance requirements) present. For example, inhibitor tubes 114 may include 3, 5, 6 or another number of tubes with a circular cross-section. In some embodiments, inhibitor tubes 114 may be any tubes attached or otherwise externally associated with pump 104 and/or gas separator 108, so long as the combined cross-sectional area of inhibitor tubes 114 is from about 80% to about 120% of the cross-sectional area of suction openings 118. In particular embodiments, the combined cross-sectional area of inhibitor tubes 114 may be from about 90% to about 110% of the cross-sectional area of suction openings 118, and in very particular embodiments, the combined cross-sectional area of inhibitor tubes 114 may be approximately 100% of the cross-sectional area of suction openings 118.

In some embodiments, inhibitor tubes 114 may be iron tubes welded, bolted, or otherwise fixedly attached to gas separator 108 and/or pump 104. A unitary structure including pump 104 and inhibitor tubes 114 may prevent components from being lost downhole due to hang-ups in deviated wells. However, other configurations and materials may be suitable as will be apparent to those having ordinary skill in the art. For example, inhibitor tubes 114 may be interchangeable and/or adjustable in the field to modify length, cross-sectional area, or other aspects.

Referring back to FIG. 1, protector 110 may be threadedly or otherwise operably connected or attached to pump 104 (or gas separator 108) and to motor 102, such that protector 110 may isolate and protect the motor 102 from well bore fluid entry and may absorb axial thrust from the pump 104. Protector 110 may be any type of equalizer, seal, shield, or protector, such as a protector available from Global Artificial Lift of Hominy, Okla. Motor 102 may be threadedly or otherwise attached to protector 110, such that motor 102 provides power to pump 104 and/or gas separator 108. Motor 102 may be an electrical submersible motor, for example, an electric submersible motor available from Franklin Electric of Bluffton, Ind.

Centralizer 112 may be attached at a lower end of motor 102 to centralize pump assembly 100. However, centralizer 112 may be in any of a number of locations, or combined with other elements, as will be appreciated by those having ordinary skill in the art. In some embodiments, centralizer may be attached to the bottom end of the motor 102 to position the motor 102 in the casing and/or for cooling and/or preventing galvanic corrosion.

Methods for pumping produced fluids 120 may include providing pump assembly 100. As indicated above, pump assembly 100 may include pump 104 with suction openings 118 in fluid communication with produced fluids 120, motor 102 configured to provide power to pump 104, and at least one inhibitor tube 114 having outlet 122 in fluid communication with suction openings 118. Methods for pumping produced fluids 120 may also include placing pump assembly 100 in wellbore 128 and powering motor 102 to actuate pump 104. In some embodiments, pump assembly 100 may be set beyond any dogleg or other turn within wellbore 128. Pump 104 may be set roughly 20 degrees from horizontal. As produced fluids 120 pass upward in annulus 130, natural gas separation may occur, allowing gas to separate from remainder of produced fluids 120. As this happens, the gas portion may continue upward through annulus 130, while the remaining produced fluids 120 are drawn into inhibitor tube 114 into suction openings 118 for separation into a substantially gas portion and a substantially liquid portion. The substantially liquid portion may be passed to production tubing 106 for dispatch to surface 116. The substantially gas portion may pass through discharge openings 126 into annulus 130. This substantially gas portion tends to naturally rise to a top side of the casing (if wellbore 128 is cased), preventing re-introduction into production string 106. Once the substantially gas portion (e.g., free gas) rises up to the top side of the casing, it eventually rises to surface 116 and is introduced into the production line as designed.

Using the assemblies and methods of the present invention may allow for the prevention and/or reduction of free gas being produced through pump 104 and/or production string 106, further enhancing gas production. As inhibitor tubes 114 pull in produced fluids 120, produced fluids 120 make a turn of approximately 180 degrees, allowing for further natural separation of gas. Thus, inhibitor tubes 114 may increase pump efficiency and prevent and/or reduce gas locking While gas separator 108 is disclosed herein, it may be merely a compliment to the natural separation of gas occurring prior to entry into pump 104, allowing for reduction or elimination of any remaining free gas. Gas separator 108 may, therefore, be secondary to natural separation that has already occurred when produced fluids 120 enter gas separator 108 and subsequently pump 104 via inhibitor tubes 114. This may prevent gas locking of pump 104 which can result in the entire system shutting down. Without gas locking, the system may run continuously, meaning fewer start/stops. Thus, the life of an ESP motor may be increased, while improving stresses on the entire system, including shafts and motor windings.

The assemblies and methods of the present invention may be particularly suitable for Coal Bed Methane (CBM) wells and/or wells that are at acute angles with respect to the horizontal, which may allow users to take full advantage of the natural separation of water (or other liquids) and gas. As one example without limitation, assemblies and methods may be particularly suitable for wells that are approximately 10-20 degrees from horizontal. However, assemblies and methods may be particularly suitable for wells that are at other angles. While drawing the water level down may result in a higher gas production (depending on the gas bubble point), particularly on the high side, the assemblies and methods of the present invention may enhance gas production up the low side, preventing gas in any significant magnitude from being re-introduced into pump 104. Thus, the assemblies and methods of the present invention may be suitable for any deviated wells, or even for vertical wells.

The assemblies and methods of the present invention may allow for substantial reduction in installation cost. For example, it may not be necessary to provide elements associated with an inverted shroud which may be cumbersome, time-consuming to install, and expensive, such as shroud hanger, Monel bolts, or shroud. Further, the risk of losing a shroud hanger or shroud downhole may be reduced or eliminated. The materials for the assemblies and methods of the present invention may be more economical than alternatives, and may be field installable once a design is modified for a particular fit.

EXAMPLES

Figure 4:
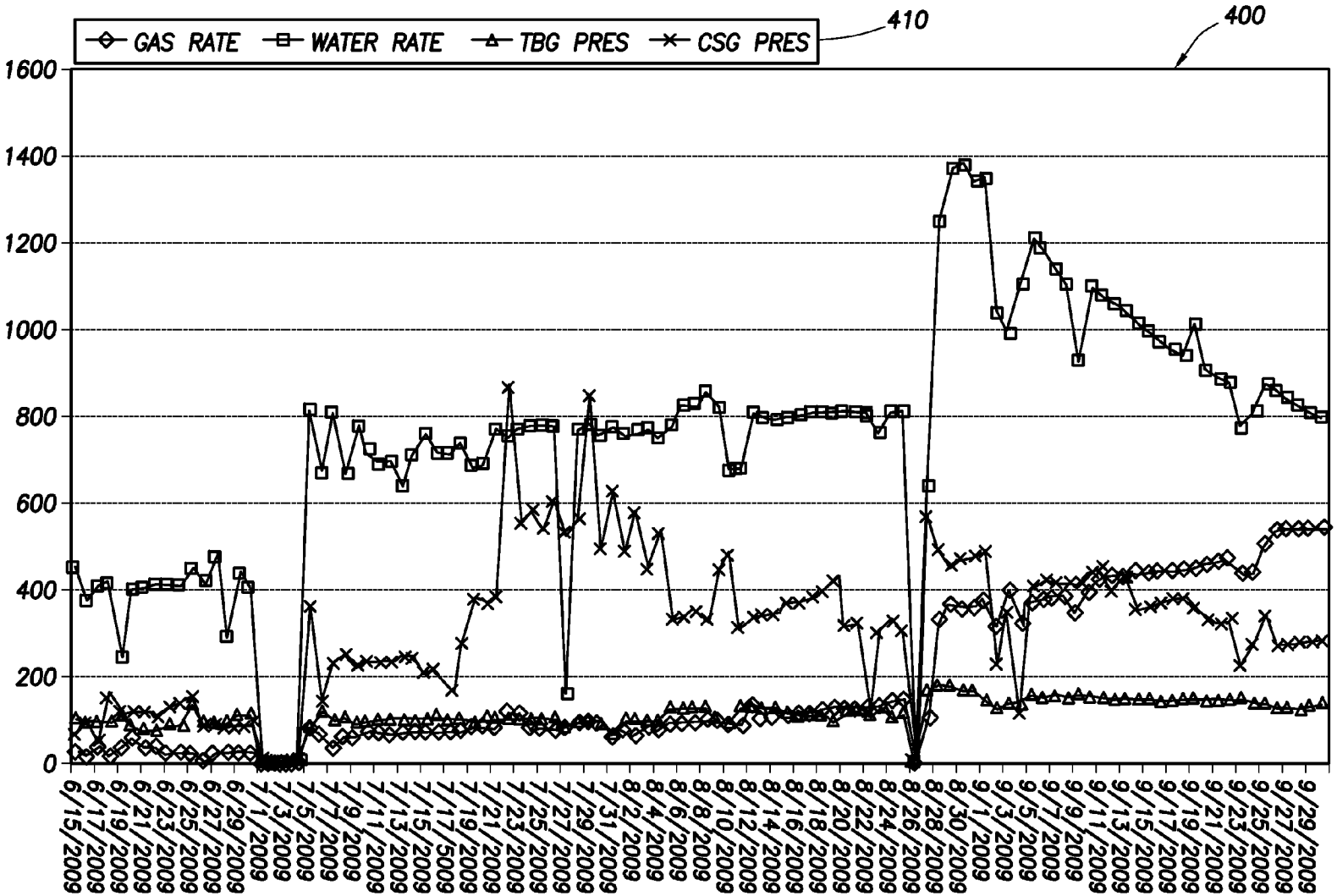
FIG. 4 is a graph illustrating the performance of one example of a pump assembly, in accordance with an exemplary embodiment of the present invention.

In some instances, the present invention may allow for gas production to be increased around 400% or as much as 440% and water production may be reduced by as much as 57%. FIG. 4 shows a graph 400 of the results of a study completed in September 2009. The vertical axis of graph 400 indicates barrels per day between zero and 1600; the horizontal axis indicates dates of collection of data. As indicated by legend 410, diamonds on the chart indicate daily gas rate data points (metered); squares indicate daily water rate data points; triangles indicate daily tubing pressure data points; and x's indicate daily casing pressure data points. From about Jun. 15, 2009 to Jul. 1, 2009, a rod pump was used in a wellbore.

A first ESP with no inverted tube design was substituted for the rod pump on about Jul. 1, 2009. That ESP was a 153-stage D13 (450 BPD, 13 GPM) with a charger pump built with 8 stages of D51. The system repeatedly experienced gas locking and resultant shutdowns.

On Aug. 26, 2009, a second ESP assembly was substituted for the first ESP. The second ESP assembly did not include a charger pump but did include a 125-stage D51 (1750 BPD, 51 GPM) ESP and a new inverted tube design in accordance with certain embodiments of the present disclosure. The system no longer experienced gas locking even with a much higher flow rate. An increase in gas production was immediately apparent, without a significant increase in tubing pressure or casing pressure. For example, gas rates increased as much 440%. Tubing pressure stabilized at roughly 150 psi, and casing pressure at roughly 280 psi. Water production was reduced by as much as 57%, as the water rate dropped to 80 BPD after 30 days.

As used herein the term "substantially gas portion" and "substantially liquid portion" mean that that portion is generally composed of gas or liquid, respectively. However, it should be appreciated that pump 104 may put gas back into solution if conditions allow for such. Thus, one example of a substantially liquid portion may contain as much as approximately 10% gas in solution.

Therefore, the present invention is well-adapted to carry out the objects and attain the ends and advantages mentioned as well as those which are inherent therein. While the invention has been depicted and described by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Moreover, the indefinite articles "a" or "an", as used in the claims, are defined herein to mean one or more than one of the element that it introduces. Also, the terms in the claims have their plain, ordinary meaning unless otherwise explicitly and clearly defined by the patentee. The terms in the claims have their plain, ordinary meaning unless otherwise explicitly and clearly defined by the patentee.

What is claimed is:

1. A pump assembly comprising:

a pump having a suction opening;

a motor configured to drive the pump; and an inhibitor tube having an outlet configured to be in fluid communication with the suction opening;

wherein the inhibitor tube does not surround the pump, wherein the inhibitor tube has an intake and wherein the intake is disposed above the inhibitor tube outlet, and wherein a gas separator is configured to discharge a substantially gas portion at a point between the inhibitor intake and the inhibitor outlet.

2. The pump assembly of claim 1, wherein the pump has a discharge opening between the intake and the outlet of the inhibitor tube.

3. The pump assembly of claim 1, wherein the motor is an electric submersible motor.

4. The pump assembly of claim 1, comprising a protector operably connected to the pump.

5. The pump assembly of claim 1, comprising a centralizer coupled to the motor.

6. The pump assembly of claim 1, wherein the gas separator has an inlet, a first outlet and a second outlet, wherein the gas separator is coupled to the pump and is configured to discharge the substantially gas portion through the first outlet and a substantially liquid portion through the second outlet.

7. The pump assembly of claim 6, wherein the second outlet is configured to be in fluid communication with the suction opening.

8. A pump assembly comprising:

a pump;

a gas separator configured to receive fluid via a suction inlet and discharge a substantially liquid portion toward the pump; and an inhibitor tube having an inhibitor outlet disposed proximate to the suction inlet wherein the inhibitor tube does not surround the pump or gas separator, and wherein the inhibitor tube has an inhibitor inlet and wherein the inhibitor inlet is disposed above the inhibitor outlet.

9. The pump assembly of claim 8, wherein the gas separator is configured to discharge a substantially gas portion toward an area external to the gas separator and the pump.

10. The pump assembly of claim 9, wherein the gas separator is configured to discharge the substantially gas portion at a point between the inhibitor inlet and the inhibitor outlet.

11. The pump assembly of claim 9, wherein the pump is disposed in a deviated wellbore.

12. The pump assembly of claim 8, comprising a motor configured to drive the pump.

13. The pump assembly of claim 12, wherein the motor is an electric submersible motor.

14. The pump assembly of claim 8, wherein the inhibitor tube has a rectangular cross-sectional area.

15. The pump assembly of claim 8, wherein the pump is configured to pressurize the substantially liquid portion for production.

16. A method for pumping comprising:

providing an assembly comprising a pump having a suction opening in fluid communication with produced fluids, a motor configured to drive the pump, and an inhibitor tube having an inhibitor outlet in fluid communication with the suction opening, wherein the inhibitor tube does not surround the pump;

placing the assembly in a wellbore;

powering the motor to actuate the pump; wherein the placing the assembly in the wellbore comprises disposing the assembly so that an inhibitor inlet is disposed above the inhibitor outlet;

allowing the produced fluids to pass through the inhibitor tube and separate into a substantially gas portion and a substantially liquid portion;

pumping the substantially liquid portion up through production tubing; and allowing the substantially gas portion to move upward through an annulus.

17. The method of claim 16, wherein the assembly comprises a gas separator configured to discharge a further substantially gas portion toward an area external to the gas separator and the pump.

* * * * *